US009556870B2

(12) United States Patent
Labbett et al.

(10) Patent No.: US 9,556,870 B2
(45) Date of Patent: Jan. 31, 2017

(54) SLIDING VANE PUMP

(75) Inventors: John Labbett, Southampton (GB); Neil Tindle, Ringwood (GB); William Rawnsley, Jr., Murfreesboro, TN (US)

(73) Assignee: Xylem IP Holdings LLC, White Plains, NY (US)

( * ) Notice: Subject to any disclaimer, the term of this patent is extended or adjusted under 35 U.S.C. 154(b) by 172 days.

(21) Appl. No.: 13/990,601

(22) PCT Filed: Nov. 30, 2011

(86) PCT No.: PCT/GB2011/052361

§ 371 (c)(1),
(2), (4) Date: Oct. 16, 2013

(87) PCT Pub. No.: WO2012/073022

PCT Pub. Date: Jun. 7, 2012

(65) Prior Publication Data

US 2014/0030130 A1 Jan. 30, 2014

(30) Foreign Application Priority Data

Dec. 1, 2010 (GB) ..... 1020335.4

(51) Int. Cl.
*F01C 19/00* (2006.01)
*F03C 2/00* (2006.01)
(Continued)

(52) U.S. Cl.
CPC ..... *F04C 18/00* (2013.01); *F01C 21/08* (2013.01); *F01C 21/0863* (2013.01);
(Continued)

(58) Field of Classification Search
CPC ..... F04C 2/3442; F04C 15/0038; F04C 18/00; F04C 2240/20; F04C 2240/50; F04C 2240/802; F04C 2240/81; F01C 21/08; F01C 21/0863; F05C 2203/08; F05C 2203/0808
(Continued)

(56) References Cited

U.S. PATENT DOCUMENTS 3,598,510 A * 8/1971 Aoki ..... F01C 21/0863 418/268
3,973,881 A * 8/1976 Melchinger ..... F01C 21/0863 418/269
(Continued)

FOREIGN PATENT DOCUMENTS

EP 1550810 7/2005
EP 1760316 7/2007
(Continued)

OTHER PUBLICATIONS

JP59-103984 Abstract—English Language translation, 1 page.
PCT/GB2011/052361 International Search Report mailed Aug. 29, 2012 (7 pages).

*Primary Examiner* — Theresa Trieu
(74) *Attorney, Agent, or Firm* — Ware, Fressola, Maguire & Barber LLP

(57) ABSTRACT

A sliding vane pump is provided including a pump assembly having a housing with a fluid inlet and a fluid outlet formed therein, a lining member received in the housing defining a substantially cylindrical inner surface and a rotor arranged inside the lining member, defining a substantially cylindrical outer surface. The inner surface of the lining member and outer surface of the rotor define a working space therebetween. The pump assembly also comprises a plurality of vanes received in slots formed about the rotor outer surface. Each vane is arranged to slide in the radical direction with respect to the rotor such that an outer edge of the vane contacts the lining member inner surface, thereby dividing the working space into working chambers. Rotation of the
(Continued)

rotor draws fluid from the fluid inlet working into the working chambers, which is ejected into the fluid outlet.

41 Claims, 5 Drawing Sheets

(51) Int. Cl.

| | |
|---|---|
| ***F03C 4/00*** | (2006.01) |
| ***F04C 2/00*** | (2006.01) |
| ***F04C 18/00*** | (2006.01) |
| ***F01C 21/08*** | (2006.01) |
| ***F04C 2/344*** | (2006.01) |
| ***F04C 15/00*** | (2006.01) |

(52) U.S. Cl.
CPC ..... *F04C 2/3442* (2013.01); *F04C 15/0038* (2013.01); *F04C 2240/20* (2013.01); *F04C 2240/50* (2013.01); *F04C 2240/802* (2013.01); *F04C 2240/81* (2013.01); *F05C 2203/08* (2013.01)

(58) Field of Classification Search
USPC ..... 418/259–260, 104, 152–153, 266–268, 418/82
See application file for complete search history.

(56) References Cited

U.S. PATENT DOCUMENTS

| | | | | |
|---|---|---|---|---|
| 4,748,136 | A * | 5/1988 | Mahulikar et al. | 501/32 |
| 5,509,388 | A | 4/1996 | Andres | |
| 5,642,991 | A | 7/1997 | Singleterry et al. | |
| 5,791,888 | A * | 8/1998 | Smith | 418/259 |
| 6,652,239 | B2 * | 11/2003 | Carstensen | 417/44.11 |
| 7,878,779 | B2 * | 2/2011 | Koehler | F01C 21/0863 418/268 |
| 2004/0131477 | A1 | 7/2004 | Dalton et al. | |
| 2005/0047938 | A1 | 3/2005 | Konishi et al. | |
| 2008/0253913 | A1 * | 10/2008 | Langenbach | F04C 2/101 418/75 |

FOREIGN PATENT DOCUMENTS

| | | |
|---|---|---|
| JP | 59119087 | 7/1984 |
| JP | 60006091 | 1/1985 |
| JP | 60006092 | 1/1985 |
| JP | 62126281 | 6/1987 |
| JP | 63147979 | 6/1988 |
| JP | 09126156 | 5/1997 |
| JP | 2002276562 | 9/2002 |
| WO | 03056180 | 7/2003 |

* cited by examiner

SLIDING VANE PUMP

CROSS-REFERENCE TO RELATED APPLICATIONS

This application corresponds to international patent application Ser. No. PCT/GB2011/052361, filed 30 Nov. 2011, which claims benefit to GB patent application Ser. No. 1020335.4, filed 1 Dec. 2010, which is incorporated by reference in its entirety.

FIELD OF THE INVENTION

This invention relates to a sliding vane pump. In particular, the invention relates to a sliding vane pump of the type in which a rotor is provided with a plurality of radially-extending vanes which are slidably mounted in slots. The rotor is arranged within a tubular lining member and outer edges of the sliding vanes contact an internal surface of the lining member, thereby defining a plurality of working chambers between the rotor and the lining member. The volume of the working chambers varies as the rotor is rotatably driven by a prime mover, such that a pumped fluid can be transferred from an inlet to an outlet of the pump.

BACKGROUND TO THE INVENTION

Sliding vane pumps are well known. They typically find favour in a wide variety of applications, such as ambient carbonation systems for producing beverages, commercial espresso coffee making equipment and cooling equipment in which a coolant is circulated. These diverse applications have in common the need for a positive displacement pump having a relatively high working pressure and flow rate, together with a long, maintenance-free operational life. These needs are met by the sliding vane pump.

Although the characteristics and performance of sliding vane pumps are adequate in many respects, there remains scope for improvement. For example, the housings of many sliding vane pumps are formed of brass alloys containing small amounts of lead. However, the use of lead in the pump housing is generally undesirable and may render a pump unsuitable for use in potable water applications, including the ambient carbonation systems and espresso coffee making equipment mentioned hereinabove. It is known to avoid this problem by forming the pump housing from stainless steel, but this comes at significantly increased cost. Plastics materials have also been proposed, but the associated moulding processes and strength issues introduce further complexity.

Another performance issue relates to the operating of sliding vane pumps in the so-called bypass mode. Sliding vane pumps are usually provided with a bypass valve which allows the pumped fluid to be transferred from an outlet to an inlet of the pump when the pressure at the outlet exceeds a predetermined level. In many applications, such as the ambient carbonation systems and espresso coffee making equipment mentioned hereinabove, the pump operates in the bypass mode for prolonged periods of time. Such operation can cause a build up of heat in the pumped fluid which, in turn, causes thermal expansion of pump components together with increased wear and premature failure of the pump. The inventors have identified a particular failure mode whereby thermal expansion of the rotor causes the vanes to become jammed in their slots.

SUMMARY OF THE INVENTION

According to a first aspect of the invention, there is provided a sliding vane pump assembly for providing positive displacement of a fluid, the pump assembly comprising:

a housing having a fluid inlet and a fluid outlet formed therein;

a lining member received in the housing and defining a substantially cylindrical inner surface;

a rotor arranged inside the lining member to rotate about a rotational axis, the rotor defining a substantially cylindrical outer surface, the inner surface of the lining member and the outer surface of the rotor defining a working space therebetween, the working space having a radial cross-sectional area which varies about the rotational axis; and a plurality of vanes received in substantially radial slots formed about the outer surface of the rotor, each of the vanes being arranged to slide in the radial direction with respect to the rotor such that an outer edge of the vane contacts the inner surface of the lining member, thereby dividing the working space into working chambers, wherein rotation of the rotor draws the fluid from the fluid inlet into the working chambers and ejects the fluid from the working chambers into the fluid outlet, and wherein base portions of the slots formed in the rotor are in fluid communication with each other.

The inventors have found that the base portions of the slots formed in the rotor of a known sliding vane pump typically behave as partially or imperfectly sealed volumes during use of the pump. The partially sealed volumes are bounded in the radially outwards direction by inner surfaces of the sliding vanes. As the rotor rotates in the lining member, the sliding of the vanes is resisted by pressure variations across the inner and outer faces of the vanes. In particular, sliding in a radially outwards direction is resisted by a pressure drop underneath the vanes and sliding in a radially inwards direction is resisted by a pressure increase underneath the vanes. The pressure variations arise because large volumes of fluid cannot quickly flow into our out of the partially or imperfectly sealed volumes underneath the vanes. This problem can be exacerbated by pump assemblies which are manufactured to small tolerances and/or which experience significant thermal expansion, for example as a consequence of operating in a bypass mode for prolonged periods of time.

By arranging the pump assembly so that base portions of the rotor slots are in fluid communication with each other, preferably constantly during use of the pump, the disadvantageous pressure variations across the vanes which resist the sliding movement of the vanes can be reduced or even substantially avoided. In this way, the risk of pump malfunctions may be reduced and pump efficiency may be improved.

In preferred embodiments, the fluid communication may be provided by at least one fluid conduit in the pump assembly. It has been found that fluid flow through the at least one fluid conduit may be used to assist in making the sliding movement of the vanes. For example, when a vane is urged in the radially inwards direction by direct contact of its radially outer face with the lining member, the increased pressure underneath the vane can be transmitted through the conduit to assist in urging another vane to move in the radially outwards direction. In this way, the fluid communication between the base portions may positively contribute to the reduction of malfunctions caused by improper sliding of the vanes.

The at least one fluid conduit may take the form of a passageway or bore formed in one or more of the pump components. For example, a plurality of radially extending fluid conduits may be formed in the rotor and extend from the inner faces of the slots to the centre of the rotor. The base portions of the slots may be coupled in groups. For example, opposite pairs of the slots may be independently coupled by a conduit extending through the centre of the rotor. The passageway or bore may have any cross-sectional shape, such as circular.

The at least one fluid conduit may alternatively take the form of at least one groove or channel formed into one or more of the pump components. For example, a substantially circular groove may be formed in one or both end surfaces of the rotor and/or in surfaces of other components that face the end surfaces of the rotor. The circular groove may be coaxial with the rotational axis of the rotor. The radius of the circular groove may correspond to the radial position of the base portions of the slots formed in the rotor. In other embodiments, the at least one conduit may comprise a plurality grooves or channels shaped as circular arcs which may be coupled together by other grooves in any suitable configuration. The at least one groove or channel may have any cross-sectional shape, such as semi-circular or U-shaped.

In embodiments of the invention, the rotor may be formed of a ceramic material. Compared to conventional materials for rotors, such as brass alloys and stainless steels, ceramic materials exhibit a lower amount of thermal expansion across a given temperature range. This reduced thermal expansion helps to prevent the vanes from becoming jammed in their slots when the temperature of the pump assembly becomes elevated, for example during operation in a bypass mode for a prolonged period of time. In this way, the risk of pump failures in the form of jammed or broken vanes may be reduced. The reduced friction between the components may also provide reduced wear and increased pump efficiency.

The ceramic material of the rotor may be any engineering-grade ceramic material. For example, the material of the rotor may comprise at least one of alumina ceramic ($Al_2O_3$), silicon nitride ceramic ($Si_3N_4$) and zirconia ceramic ($ZrO_2$). Other ceramic materials which may be suitable include silicon carbide ceramic (SiC), titania ceramics, mullite ceramics and cordierite ceramics. A particularly preferred ceramic material for the rotor is alumina ceramic ($Al_2O_3$) having a purity of 96.0 to 99.9 wt %. The entire rotor may be formed of the ceramic material or the rotor may be a sub-assembly in which certain components are formed of the ceramic material.

For example, particularly suitable ceramic materials may have an expansivity $\alpha$ of less than or equal to $10.0\times10^{-6}$ $K^{-1}$, preferably less than or equal to $8.0\times10^{-6}$ $K^{-1}$, and more preferably less than or equal to $6.0\times10^{-6}$ $K^{-1}$, all at 293K.

The vanes may be formed of a carbon graphite material or may alternatively be formed of a ceramic material, such as the same or a different ceramic material to that of which the rotor is formed. The vanes may in particular be formed of at least one of the materials described hereinabove in respect of the rotor, i.e. alumina ceramic ($Al_2O_3$), silicon nitride ceramic ($Si_3N_4$), zirconia ceramic ($ZrO_2$), silicon carbide ceramic (SiC), titania ceramics, mullite ceramics and cordierite ceramics.

A base portion of each of the slots formed in the rotor may have an enlarged width and a rounded, lobed cross-sectional shape. The base portion extends substantially in the axial direction. Such an enlarged base portion may be easier to form, for example by typical machining operations and, in use of the pump, peak stresses around the slots may be reduced by the omission of sharp internal corners.

The lining member may be formed of a carbon graphite material, such as a metal impregnated carbon graphite material or a resin-bonded carbon graphite material. Alternatively, the lining member may be formed of a ceramic material, such as those described above with respect to the rotor and vanes. An outer surface of the lining member may be provided with a first recessed area in fluid communication with the fluid inlet and a second recessed area in fluid communication with the fluid outlet. The recessed areas and an inner surface of the housing may together define fluid passageways for transferring fluid between the fluid inlet and fluid outlet and the working chambers. In this way, the geometry of the fluid passageways may be substantially independent of the housing design. In other words, the inner surfaces of the housing which face the outer surface of the lining member need not have any recessed areas. By providing the recessed areas in the lining member, the geometry of the fluid passageways may be more adaptable and may, for example, provide less flow resistance. The lining member is preferably a moulded component in which the recessed areas are formed by the mould profile.

The pump assembly preferably further comprises a drive shaft arranged to rotate about the rotational axis, such that a drive end of the drive shaft extends out of the housing. The drive shaft is preferably releasably engaged with the rotor for rotationally driving the rotor, such that the rotor can be separated from the drive shaft for replacement or repair. The engagement between the drive shaft and the rotor may be such that the rotor is able to move along the drive shaft to some degree.

The pump assembly may also comprise a bearing and a mechanical seal. The bearing is arranged to rotatably support the drive shaft adjacent to its drive end and may comprise a rotatable part coupled to the drive shaft and a static part received in an end portion of the housing. The mechanical seal is arranged between the rotor and the bearing for preventing fluid leakage along the drive shaft and out of the end portion of the housing. The seal may comprise a rotatable part coupled to the drive shaft and a static part coupled to the housing. The rotatable part may have a low friction sealing surface which is resiliently biased into engagement with a low friction sealing surface of the static part by a spring element.

The static part of the mechanical seal may be seated on a shoulder provided in the inner surface of the housing which faces the rotatable part of the seal, the shoulder providing a reaction force opposing the resilient bias of the spring element. The shoulder provided in the inner surface of the housing may be integrally formed with the housing.

The static part of the bearing may be seated on a shoulder provided in the inner surface of the housing which faces the drive end of the drive shaft. This shoulder may also be integrally formed with the housing. The rotatable part of the bearing may be seated on a shoulder provided in the drive shaft which faces the shoulder on which the static part is seated, such that the drive shaft is prevented from moving axially under the resilient bias of the spring element. In this way, friction between components that would otherwise be caused by the thrust of the spring element can be avoided. The shoulder in the drive shaft may be provided by a circlip mounted in a circumferential groove in the drive shaft, which circlip may be mounted after the shaft has been assembled into the bearing.

The pump assembly preferably further comprises first and second bearing members received in the housing and arranged at either end of the rotor. The bearing members may define end walls of the working chambers. The bearing members may be formed of a carbon graphite material, such as a metal impregnated carbon graphite material or a resin-bonded carbon graphite material, to minimise friction with the rotating rotor. Alternatively, the lining members may be formed of a ceramic material, such as those described above with respect to the rotor and vanes.

In particular embodiments of the invention, the at least one fluid conduit providing fluid communication between the base portions of the slots in the rotor comprises a substantially circular groove formed in the end surfaces of one or both other the bearing members, in particular the end surfaces that face the end surface of the rotor. The circular groove may be coaxial with the rotational axis of the rotor. The radius of the circular groove may correspond to the radial position of the base portions of the slots formed in the rotor. The at least one groove or channel may have any suitable cross-sectional shape, such as semi-circular or U-shaped.

One or both of the bearing members may be provided with a first recessed area in fluid communication with the fluid inlet and a second recessed area in fluid communication with the fluid outlet. The recessed areas and end surfaces of the lining member together define fluid passageways for transferring fluid between the fluid inlet and fluid outlet and the working chambers.

The housing may be a moulded plastics component, for example formed of a fibre-reinforced plastics material.

The sliding vane pump assembly preferably further comprises a removable strainer assembly, the strainer assembly being received into an opening in the housing and extending across the fluid inlet for filtering particulate matter from the fluid. By filtering particulate matter, friction and wear between the components of the pump assembly may be reduced. The strainer assembly may comprise a strainer sleeve formed of porous or perforated material.

The strainer assembly may further comprise a thermal sensor for providing an electrical signal indicative of temperature. The thermal sensor may be provided in a sealing cap for the opening of the housing in which the strainer is received. Such an arrangement is advantageous because it enables the sensor to be placed in close proximity to fluid passing through the fluid inlet, so that the sensor is able to accurately detect temperature variations at the fluid inlet. Furthermore, by mounting the temperature sensor in a removable component of the pump assembly, manufacturing and maintenance operations may be simplified.

According to a second aspect of the invention, there is provided a sliding vane pump assembly for providing positive displacement of a fluid, the pump comprising:

a housing having a fluid inlet and a fluid outlet formed therein;

a lining member received in the housing and defining a substantially cylindrical inner surface;

a rotor arranged inside the lining member to rotate about a rotational axis, the rotor defining a substantially cylindrical outer surface, the inner surface of the lining member and the outer surface of the rotor defining a working space therebetween, the working space having a radial cross-sectional area which varies about the rotational axis;

a plurality of vanes received in substantially radial slots formed about the outer surface of the rotor, each of the vanes being arranged to slide in the radial direction with respect to the rotor such that an outer edge of the vane contacts the inner surface of the lining member, thereby dividing the working space into working chambers;

a drive shaft arranged to rotate about the rotational axis, wherein a drive end of the drive shaft extends out of the housing, the drive shaft being releasably engaged with the rotor for rotationally driving the rotor;

a bearing arranged to rotatably support the drive shaft adjacent to its drive end, the bearing comprising a rotatable part coupled to the drive shaft and a static part received in an end portion of the housing; and a mechanical seal arranged between the rotor and the bearing for preventing fluid leakage along the drive shaft and out of the end portion of the housing, the mechanical seal comprising a rotatable part coupled to the drive shaft and a static part coupled to the housing, wherein the rotatable part has a sealing surface which is resiliently biased into engagement with a sealing surface of the static part by a spring element, wherein rotation of the rotor draws the fluid from the fluid inlet into the working chambers and ejects the fluid from the working chambers into the fluid outlet, and wherein the static part of the bearing is seated on a shoulder provided in the inner surface of the housing which faces the drive end of the drive shaft, and wherein the rotatable part of the bearing is seated on a shoulder provided in the drive shaft which faces the shoulder on which the static part is seated, such that the drive shaft is prevented from moving axially under the resilient bias of the spring element.

This aspect provides a pump assembly in which the drive shaft is prevented from moving axially under the resilient bias of the spring element. In this way, friction between components that would otherwise be caused by the thrust of the spring element can be avoided. Instead, the thrust of the drive shaft is resisted by the shoulder provided in the drive shaft which bears against the rotatable part of the bearing.

The shoulder in the drive shaft may be provided by a circlip mounted in a circumferential groove in the drive shaft.

The drive shaft may be releasably engaged with the rotor for rotationally driving the rotor. The engagement between the drive shaft and the rotor may be such that the rotor is able to move along the drive shaft.

The static part of the mechanical seal may be seated on a shoulder provided in the inner surface of the housing which faces the rotatable part of the mechanical seal, the shoulder providing a reaction force opposing the resilient bias of the spring element. Each of the shoulders in the inner surface of the housing may be integrally formed in the housing, particularly if the housing is formed of a plastics material.

According to a third aspect of the invention, there is provided a sliding vane pump assembly for providing positive displacement of a fluid, the pump comprising:

a housing having a fluid inlet and a fluid outlet formed therein;

a lining member received in the housing and defining a substantially cylindrical inner surface;

a rotor arranged inside the lining member to rotate about a rotational axis, the rotor defining a substantially cylindrical outer surface, the inner surface of the lining member and the outer surface of the rotor defining a working space therebetween, the working space having a radial cross-sectional area which varies about the rotational axis;

a plurality of vanes received in substantially radial slots formed about the outer surface of the rotor, each of the vanes being arranged to slide in the radial direction with respect to the rotor such that an outer edge of the vane contacts the inner surface of the lining member, thereby dividing the working space into working chambers; and a removable strainer assembly, the strainer assembly being received into an opening in the housing and extending across the fluid inlet for filtering particulate matter from the fluid, wherein rotation of the rotor draws the fluid from the fluid inlet into the working chambers and ejects the fluid from the working chambers into the fluid outlet, and wherein the strainer assembly comprises a thermal sensor for providing a electrical signal indicative of temperature.

This aspect of the invention provides pump assembly having a strainer assembly which comprises a thermal sensor. Such an arrangement is advantageous because it enables the sensor to be placed in close proximity to fluid passing through the fluid inlet, so that the sensor is able to accurately detect temperature variations in the fluid inlet. Furthermore, by mounting the temperature sensor in a removable component of the pump assembly, manufacturing and maintenance operations may be simplified.

The strainer assembly may comprise a strainer sleeve formed of porous or perforated material and having a closed end. In use of the pump assembly, fluid is directed into the sleeve and is drawn out through the porous or perforated material into the working chambers. Any particulate matter collected inside the sleeve may be periodically removed by withdrawing the strainer assembly from the housing. The thermal sensor may be provided in a sealing cap for the opening in the housing in which the strainer is received.

Any of the pump assemblies described above may further comprise a bypass valve arranged between the fluid outlet and the fluid inlet to allow the pumped fluid to flow from the fluid outlet to the fluid inlet when the pressure at the fluid outlet exceeds a predetermined level.

The invention also provides a sliding vane pump comprising any of the sliding vane pump assemblies described hereinabove and a prime mover arranged to rotatably drive the rotor of the sliding vane pump assembly. The prime mover may be an electric motor.

The invention also provides a method of using the sliding vane pump described hereinabove for pumping water in a beverage carbonation system or an espresso coffee machine. In such applications, the pump may operate in a bypass mode for prolonged periods of time. The invention also provides a method of using the sliding vane pump described hereinabove in other applications, including pumping fluid in reverse osmosis water treatment equipment and heating or cooling circuits.

Other features and advantages of embodiments of the invention will become apparent from the following detailed description.

BRIEF DESCRIPTION OF THE DRAWINGS

A preferred embodiment of the invention will now be described with reference to the following drawings, in which.

DETAILED DESCRIPTION

The invention provides a sliding vane pump assembly for providing positive displacement of a fluid such as water. The pump assembly comprises a housing having a fluid inlet and a fluid outlet formed therein, a lining member received in the housing and defining a substantially cylindrical inner surface and a rotor arranged inside the lining member to rotate about a rotational axis. The rotor defines a substantially cylindrical outer surface such that the inner surface of the lining member and the outer surface of the rotor define a working space therebetween, the working space having a radial cross-sectional area which varies about the rotational axis. The pump assembly also comprises a plurality of vanes received in substantially radial slots formed about the outer surface of the rotor. Each of the vanes is arranged to slide in the radial direction with respect to the rotor such that an outer edge of the vane contacts the inner surface of the lining member, thereby dividing the working space into working chambers. In use, rotation of the rotor draws the fluid from the fluid inlet into the working chambers and ejects the fluid from the working chambers into the fluid outlet.

According to a first aspect of the invention, base portions of the slots formed in the rotor are in fluid communication with each other and/or the rotor is formed of a ceramic material, which may reduce the risk of the pump malfunctioning and improve pump efficiency. The use of ceramic material for the rotor provides reduced thermal expansion compared to convention materials such as stainless steels. According to a second aspect of the invention, the pump assembly further comprises a drive shaft which is mounted to a bearing and a mechanical seal such that axial movement of the drive shaft under the thrust of the mechanical seal is prevented. According to a third aspect of the invention, the pump assembly further comprises a strainer assembly received into an opening in the housing and extending across the fluid inlet for filtering particulate matter from the fluid. The strainer assembly comprises a thermal sensor for sensing a temperature of fluid passing through the fluid inlet.

The invention also provides a sliding vane pump comprising the pump assembly described hereinabove and a prime mover for driving the pump assembly.

Figure 1:
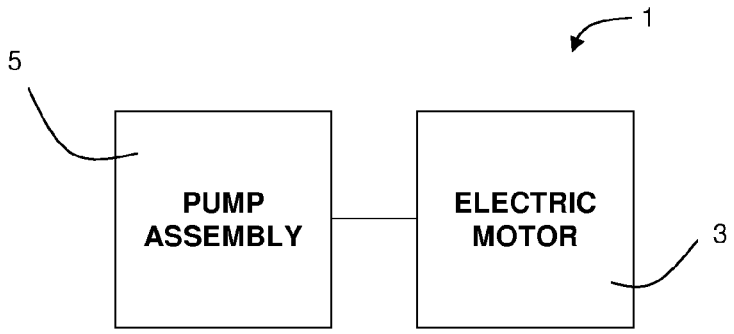
FIG. 1 is a schematic view of a pump comprising a pump assembly according to the invention.

FIG. 1 is a schematic view of a rotary vane pump 1 according to the invention. The pump 1 comprises a prime mover in the form of an electric motor 3 and a pump assembly 5, which will be described in more detail hereinbelow. The pump assembly has a drive shaft (not shown in FIG. 1) to which the electric motor 3 is coupled in a conventional manner.

Figure 2:
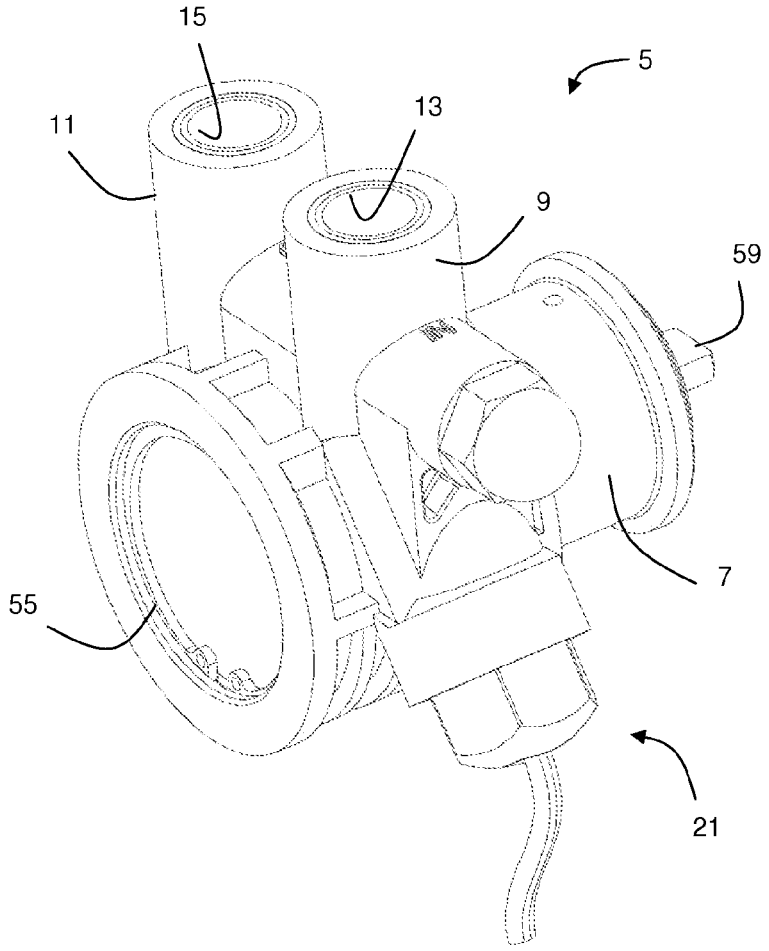
FIG. 2 is a perspective view of the pump assembly according to the invention.
Figure 3:
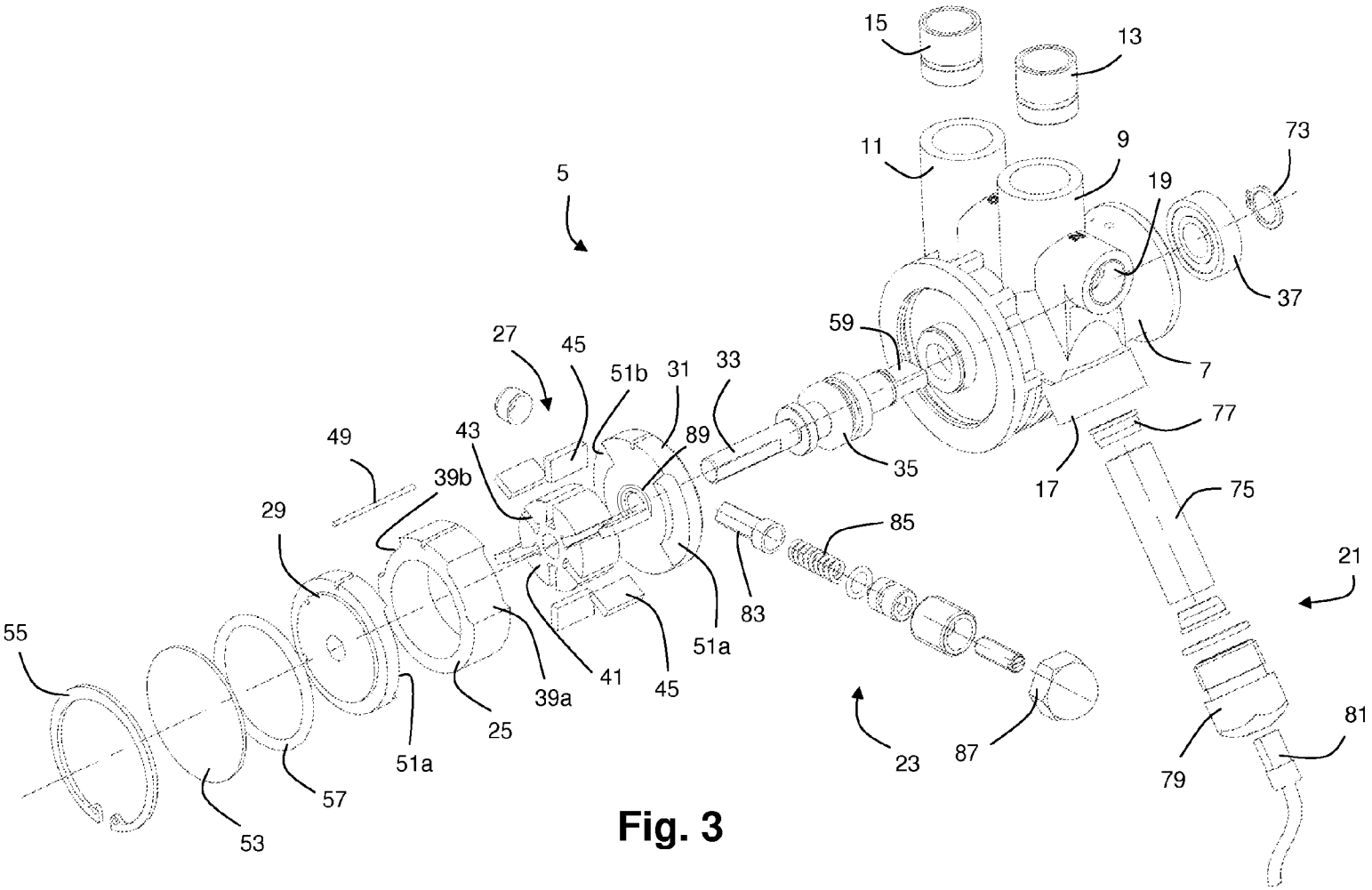
FIG. 3 is an exploded view of the pump assembly shown in FIG. 2.
Figure 4:
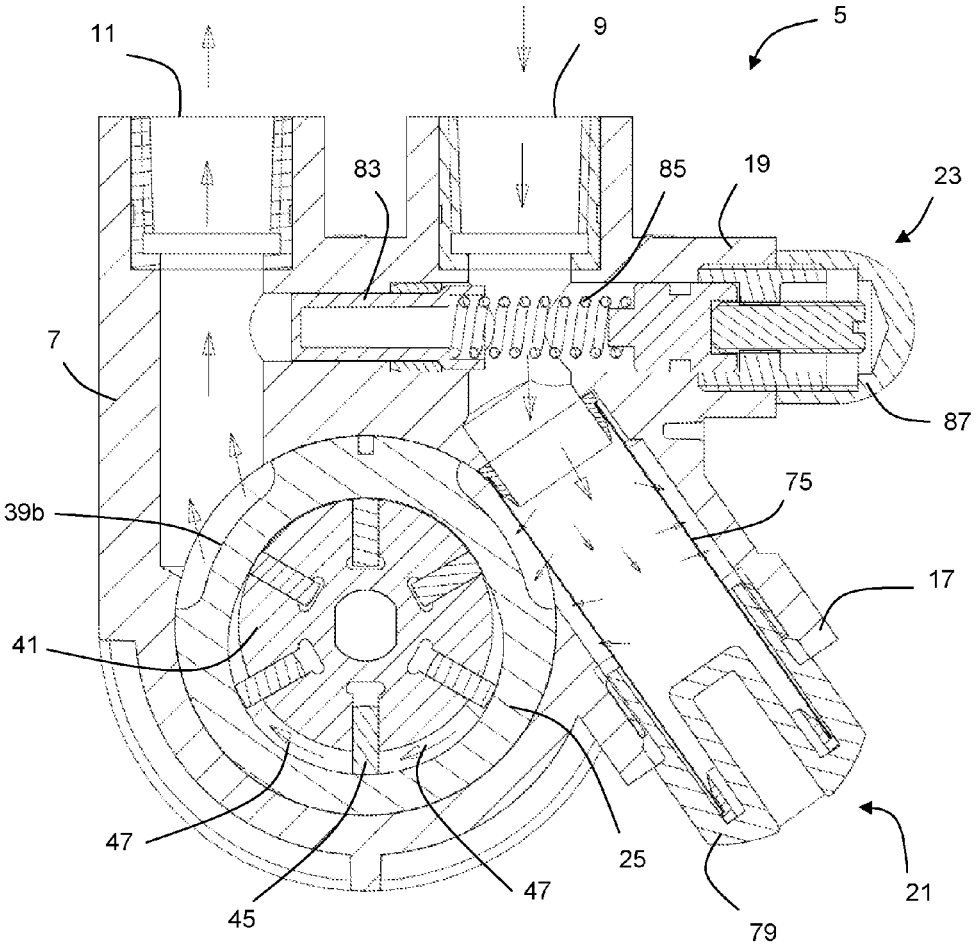
FIG. 4 is an end cross-sectional view of the pump assembly shown in FIG. 2.

The pump assembly 5 is illustrated in more detail in the perspective view of FIG. 2, the exploded view of FIG. 3 and the end cross-sectional view of FIG. 4. Referring to these drawings, the pump assembly 5 comprises a housing 7 within which various components are installed. The housing 7 is preferably a moulded component formed of a plastics material, such as a fibre-reinforced plastics material. The housing 7 has a substantially tubular configuration with different axial sections of a main opening defining internal surfaces having different diameters. The ends of the housing 7 are closed by other components which will be described hereinbelow.

The housing 7 is integrally formed with a fluid inlet 9 and a fluid outlet 11 which extend upwardly from the housing 7 as shown in FIG. 2. The fluid inlet 9 and fluid outlet 11 are provided with sleeve inserts 13, 15 formed of a metal material for engaging fluid conduit connectors (not shown). The fluid inlet 9 and fluid outlet 11 each provide a fluid passageway which is open to the inner surface of the housing 7. The housing 7 also has integrally formed openings 17, 19 for receiving a strainer assembly 21 and a bypass valve 23 which will be described in more detail hereinbelow.

The components of the pump assembly which are installed in the main opening of the housing 7 will now be described with particular reference to exploded view of FIG. 3. Received into the housing 7 are a lining member 25, a rotor assembly 27, first and second bearing members 29, 31, a drive shaft 33, a mechanical seal 35 and a bearing 37.

The lining member 25 is a moulded component formed of a carbon graphite or ceramic material. It has a cylindrical outer surface which matches a cylindrical inner surface of the housing 7. The outer surface of the lining member 25 is provided with moulded recessed areas 39*a*, 39*b* which define fluid passageways in communication with the fluid inlet 9 and the fluid outlet 11, respectively. By providing the lining member 25 with the recessed areas 39*a*, 39*b*, the need for additional machining of the inner surface of the housing 7 may be avoided. The lining member 25 also has a cylindrical inner surface having a radius which varies in the circumferential direction.

The rotor assembly 27 is received within in the lining member 25 such that it is able to rotate about a rotational axis indicated by a broken line. The rotor assembly 27 comprises a cylindrical rotor 41 formed of a ceramic material such as alumina ceramic ($Al_2O_3$) having a purity of 99 wt % or similar. The cylindrical outer surface of the rotor 41 is provided with a plurality of radially-extending slots 43. In the illustrated pump assembly 5 there are six slots 43 equally spaced apart, but more or fewer slots may alternatively be provided. A vane 45 formed of a carbon graphite or ceramic material is provided in each of the slots 43 and arranged to slide in the radial direction. A base portion of each of the slots 43 has an enlarged width and a rounded cross-sectional shape, which assists in reducing peak stress levels around the base portions of the slots 43 during use of the pump assembly 5. The enlargement also assists in machining the slots 43 during manufacture of the rotor 41.

The inner surface of the lining member 25 and the outer surface of the rotor 41 define a working space therebetween which is divided into a plurality of working chambers 47 by the vanes 45. In use of the pump assembly 5, as the rotor assembly 27 is rotatably driven, the vanes 45 reciprocate in the radial direction as the working chambers 47 rotate. Fluid is drawn from the fluid inlet 9 into the working chambers 47 and ejected from the working chambers 47 into the fluid outlet 11.

The first and second bearing members 29, 31 are arranged on either side of the rotor assembly 27 and define side walls of the working chambers 47. The bearing members 29, 31 are formed of a carbon graphite or ceramic material for reducing friction between the members 29, 31 and the rotor assembly 27. End surfaces of each of the bearing members 29, 31 which face the rotor assembly 27 are provided with recessed areas 51*a*, 51*b* which define fluid passageways in fluid communication with the working chambers 47 and the fluid passageways formed in the outer surface of the lining member 25. The end surfaces of one of the bearing members 29, 31 which face the rotor assembly 27 are also provided with circular grooves 89 (only one visible in FIG. 3) which are coaxial with the rotor 41 and have radii corresponding to the radial positions of the enlarged base portions of the slots 43 formed in the rotor 41. The purpose of the circular grooves 89 will be described in more detail hereinbelow. The outer surfaces of the lining member 25 and the bearing members 29, 31 are each provided with slot which receives an alignment pin 49 for maintaining their relative alignment.

A front end of the housing 7 is closed by a circular plate 53 which is secured in place by a circlip 55. An O-ring seal 57 is arranged in contact with the circular plate 57 for sealing purposes.

The drive shaft 33 is installed in the housing 7 from the rear end, with a drive end 59 of the drive shaft extending out of the housing 7. The drive shaft 33 engages circular holes formed in the bearing members 29, 31 and a drive hole formed in the rotor 41. The drive shaft 33 releasably engages the rotor 41 and the bearing members 29, 31 such that the rotor 41 can be dismantled from the shaft 33 for repair or replacement. The engagement is also such that the rotor 41 and the bearing members 29, 31 are able to slide in either direction along the drive shaft 33 to a limited degree.

Figure 5:
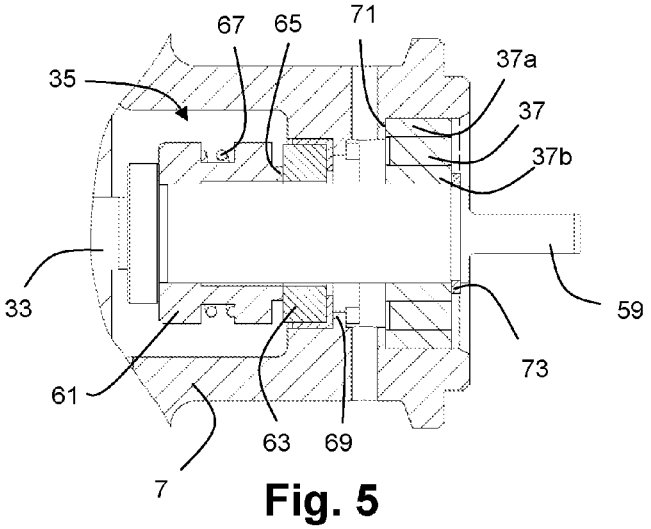
FIG. 5 is a side cross-sectional view of a part of the pump assembly shown in FIG. 2 showing a bearing and a mechanical seal.

The mechanical seal 35 and the bearing 37 are installed on the drive shaft 33 between the second bearing member 31 and the drive end 59 of the drive shaft 33 and are shown in greater detail in FIG. 5, which is a side cross-sectional view.

The bearing 37 is arranged to rotatably support the drive shaft 33 adjacent to its drive end 59. The bearing 37 is a conventional type and comprises a plurality of metal balls supported between a rotatable sleeve coupled to the drive shaft 33 and a static sleeve received in an end portion of the housing 7.

The mechanical seal 35 is arranged adjacent to the bearing 37 for preventing fluid leakage along the drive shaft 33 and out of the rear end of the housing 7. The mechanical seal 35 comprising a rotatable sleeve 61 coupled to the drive shaft 33 and a static sleeve 63 coupled to the housing 7. The rotatable sleeve has a sealing surface 65 which is resiliently biased into engagement with a sealing surface of the static 63 part by a spring element 67.

The static sleeve 63 of the mechanical seal 35 is installed in the housing 7 such that it is seated in the axial direction on a shoulder 69 that is integrally formed in the housing 7. The shoulder 69 provides a reaction force to oppose the bias of the spring element 67.

The static sleeve 37*a* of the bearing 37 is also seated on a shoulder 71 that is integrally formed in the housing 7. The drive shaft 33 is prevented from moving in the axial direction under the resilient bias of the spring element 67 by a circlip 73 which is mounted to a circumferential groove in the drive shaft 33 and bears against the rotatable sleeve 37*b* of the bearing 37. In this way, friction between static components and components rotated by the drive shaft 33 is reduced.

The removable strainer assembly 21 and the bypass valve 23 will now be described with particular reference to FIGS. 3 and 4.

The strainer assembly 21 comprises an elongated sleeve 75 formed of a porous or perforated material. The pore or perforation size is selected to prevent relevant particulate matter from passing through the material without causing an undue restriction on flow. The strainer assembly further comprises a distal end seal 77 and a sealing cap 79 which closes the sleeve 75 at a proximal end. The sealing cap 79 also seals the opening 17 in the housing 7 and is provided with a bore in which is received a temperature sensor 81. The temperature sensor 81 is an electrical temperature sensor such as a thermocouple, thermistor or similar which provides an electrical signal indicative of a temperature.

The strainer assembly 21 is installed inside the opening 17 in the housing 7, as described hereinabove. With reference to FIG. 4, it will be seen that distal end seal 77 seals the sleeve 75 to the fluid inlet 9 of the housing 7. Fluid flowing into the sleeve 75 is drawn through the porous or perforated material into the fluid passageway defined by recess 39*a* in the lining member 25. The proximity of the temperature sensor 81 to the fluid passing through the fluid inlet 9 renders the sensor 81 particularly sensitive to temperature changes at the fluid inlet 9. An output of the temperature sensor may be used, for example, to shut down power to the electrical motor 3 which drives the pump assembly 5 when the temperature exceeds a predetermined threshold. In this way, thermally-induced damage to the pump components may be avoided.

The bypass valve 23 is installed inside the opening 19 in the housing 7. This opening 19 provides a fluid passageway between the fluid outlet 11 and the fluid inlet 9. The bypass valve 23 comprises a piston 83, a compression spring 85 and an end cap 87 which includes a pressure adjustment mechanism. The piston 83 is formed with a circumferential shoulder which abuts a valve seat provided in the opening 19.

The shoulder is biased into engagement with the valve seat by the compression spring 85, which is held in place by the end cap 87. The pressure adjustment mechanism is adapted to vary the preload on the spring 85, and thereby the pressure at which the valve opens. In use of the bypass valve 23, the valve opens to allow high pressure fluid to flow from the fluid outlet 11 to the fluid inlet 9 when the pressure at the fluid outlet exceeds a predetermined level.

Figure 6:
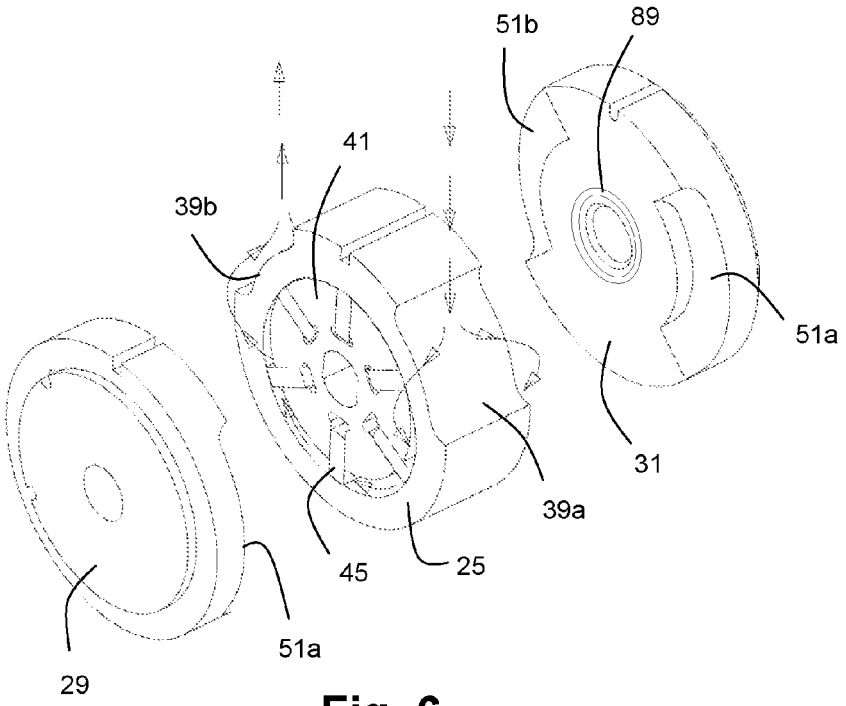
FIG. 6 is a diagram for explaining the use of the pump assembly shown in FIG. 2 for pumping a fluid.

Use of the pump 1 and pump assembly 5 for pumping a fluid will now be described with reference to FIGS. 4 and 6. FIG. 4 is an end cross-sectional view of the pump assembly. FIG. 6 is a schematic view illustrated fluid flow through fluid passageways formed by the lining member 25 and the bearing members 29, 31. Fluid flow is indicated in FIGS. 4 and 6 by arrows.

In use of the pump 1, the fluid inlet 9 is connected to a low pressure supply of fluid such as water and the fluid outlet is connected to a vessel (not shown) to which the fluid is to be pumped. Since the pump 1 is a positive displacement pump, the vessel may be a pressure vessel and the pump my transfer fluid from a low pressure supply to the vessel at a higher pressure.

The electric motor 3 shown in FIG. 1 rotatably drives the drive shaft 33 of the pump assembly 5 which, in turn, drives the rotor assembly 27. As the rotor assembly 27 rotates, the vanes 45 reciprocate in the slots 43 and the working chambers 47 rotate about the rotational axis. As the working chambers 47 rotate they initially expand in volume as they draw in fluid from the fluid inlet 9 before contracting as they expel fluid towards the fluid outlet 11. It is this expansion and contraction cycle which is able to pump the fluid against a pressure gradient.

The fluid which is drawn into the working chambers 47 passes from the fluid inlet 9, across the compression spring 85 of the bypass valve 23, and through the sleeve 75 of the strainer assembly 21. The sleeve 75 of the strainer assembly 21 collects any particulate matter in the fluid which might otherwise cause damage or excessive wear to the pump assembly 5.

The temperature sensor 81 installed in the strainer assembly 21 is sensitive to temperature fluctuations in the fluid passing through the fluid inlet 9. If the sensed temperature exceeds a predetermined threshold, then the power supply to the electric motor 3 may be cut off to shut down the pump 1 and prevent any thermally-induced damage to the pump components. Such a scenario may arise if the pump 1 operates in the bypass mode, which will be described hereinbelow, for a prolonged period of time.

The bypass valve 23 serves to regulate fluid pressure at the fluid outlet 11 by opening a fluid passageway from the fluid outlet 11 to the fluid inlet 9 when the pressure in at the fluid outlet 11 exceeds a predetermined level. The bypass valve 23 may also serve as a safety feature. When the bypass valve 23 is opened, the pump 1 is said to be operating in the bypass mode. In the bypass mode, fluid is continuously circulated through the working chambers 47 and across the fluid passageway of the bypass valve 23, thereby leading to an increase in the temperature of the fluid as it is worked. Prolonged operation in the bypass mode can lead to thermally-induced damage to the pump components unless the pump 1 is shut down, for example by cutting off the power to the electric motor 3 in response to a predetermined signal from the temperature sensor 81.

During use of the pump assembly 5, there is a continuous flow of fluid in the circular grooves 89 formed in the bearing members 29, 31 as the rotor assembly 27 rotates. This flow of fluid through the circular grooves 89 does not directly contribute to the pumping of fluid from the fluid inlet 9 to the fluid outlet 11 but instead helps to prevent malfunctions of the pump assembly 5 caused by improper sliding or jamming of the vanes 45 in their slots 43.

Each of the circular grooves 89 defines a conduit which provides fluid communication between the base portions of the slots 43 of the rotor 41. The base portions of the slots 43 define volumes which are bounded in the radially outer direction by the radially inner ends of the vanes 45 and which, were it not for the radial grooves 89, would be partially or imperfectly sealed. The fluid communication between the base portions of the slots 43 allows fluid to quickly flow between the slots 43 as the vanes 45 slide radially inwards and outwards. In this way, significant pressure variations across the radially inner and outer surfaces of the vanes 45, which can lead to vanes sticking, can be avoided. More specifically, a pressure drop underneath the vanes 45 caused by sliding in a radially outwards direction is relieved by fluid flowing into the base portion through the circular grooves 89. A pressure increase underneath the vanes 45 caused by sliding in a radially inwards direction is relieved by fluid flowing out of the base portion through the circular grooves 89. The sum of the volumes under all of the vanes 45 remains substantially constant at all times during use of the pump assembly 45, so that there is a flow of fluid between the slots 43.

It has also been found that the fluid flow through the circular grooves 89 may assist in the sliding movement of the vanes 45. More specifically, when a vane 45 is urged in the radially inwards direction by direct contact of its radially outer face with the lining member 25, the increased pressure underneath the vane 45 can be transmitted through the grooves 91 to assist in urging another vane 45 to move in the radially outwards direction. In this way, the fluid communication between the base portions of the slots 43 may positively contribute to the reduction of malfunctions caused by improper sliding of the vanes 45.

Compared to use of a conventional pump, friction between the components is also reduced in a number of ways, as is the risk of pump failures. For example, the provision of a rotor 41 formed of a ceramic material reduces friction between the rotor 41 and the vanes 45 caused by thermally-induced expansion of the rotor material. Pump failures caused by jammed and broken vanes may also be reduced.

Furthermore, the drive shaft 33 is prevented from moving axially by the circlip 73 bearing against the inner rotatable sleeve of the bearing 37. In this way, friction between static components and the drive shaft 33 and components rotationally driven by the drive shaft 33 may be reduced.

Figure 7B:
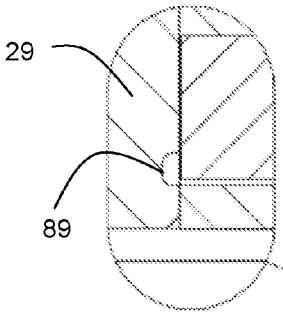
FIGS. 7*a* and 7*b* are cross-sectional views showing the detailed design of the pump assembly shown in FIG. 2.
Figure 7A:
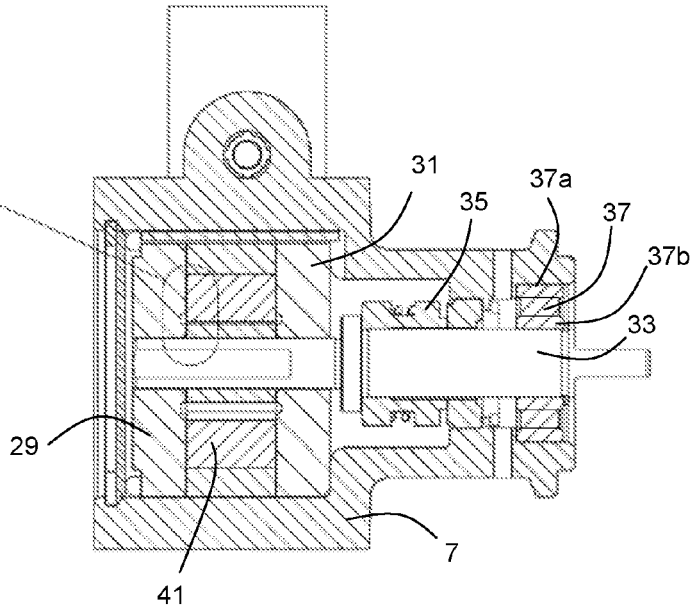

FIGS. 7*a* and 7*b* illustrate in more detail the provision of the fluid communication between the base portions of the slots 43 of the rotor 41 according to the invention. The reference numerals used in FIGS. 7*a* and 7*b* correspond to those used in the other drawings. As shown in the FIGS., the circular grooves 89 are formed in the surfaces of the first and second bearing members 29, 31 which face the rotor 41. The grooves 89 define fluid passageways which connect together the base portions of the slots 43 formed in the rotor 41. The fluid passageways serve to equalise the pressures underneath the vanes 45 as the vanes 45 reciprocate during use of the pump assembly 5.

Figure 8:
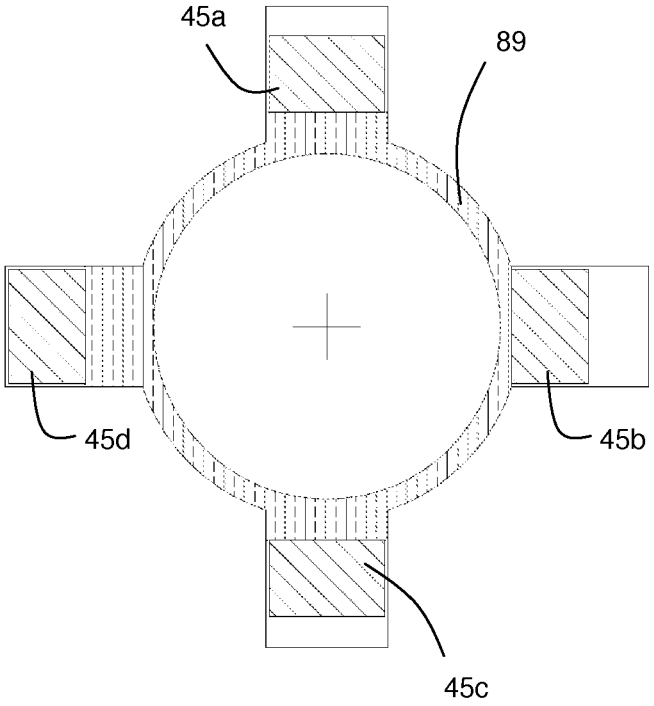
FIG. 8 is a schematic diagram for further explaining the use of the pump assembly according to the invention based on an alternative embodiment.

FIG. 8 is a schematic diagram for further explaining the use of the pump assembly 5 based on an alternative embodiment having four vanes instead of the six vanes shown in FIGS. 3 to 6. As illustrated, the four vanes 45*a*, 45*b*, 45*c*, 45*d* are arranged in respective slots of the rotor. The circular grooves 91 formed in the bearing members provide fluid communication between base portions of the slots. In FIG. 8, the four vanes 45*a*, 45*b*, 45*c*, 45*d* are arranged at different radial positions. As the rotor assembly rotates, the vanes 45*a*, 45*b*, 45*c*, 45*d* slide radially inwardly and outwardly such that their radially outer surfaces remain in contact with the lining member (not shown in FIG. 8). There is a constant flow of fluid from slots in which the vanes are sliding radially inwardly to slots in which the vanes are sliding radially outwardly. The total volume of fluid under the vanes and in the circular grooves 89 remains substantially constant.

As explained hereinabove, the flow of fluid between the slots minimises disadvantageous pressure differentials across the vanes which can cause sticking of the vanes. Furthermore, the flow of fluid can also establish advantageous pressure differentials across the vanes which promote the sliding movement of the vanes, particularly in the radially outwards direction. It will be appreciated that the precise flow of fluid between the slots is determined by the radial positions and movements of the vanes, which are determined by the shape of the inner surface of the lining member.

Preferred embodiments of the invention have been described in detail hereinabove. Various changes may be made to these embodiments without departing from the scope of the invention, which is defined by the accompanying claims.

For example, the rotor of the pump assembly described above is formed of alumina ceramic. However, other ceramic materials may be used, such as silicon nitride and zirconium dioxide.

Another aspect of the invention provides a sliding vane pump assembly for providing positive displacement of a fluid, the pump assembly comprising:

a housing having a fluid inlet and a fluid outlet formed therein;

a lining member received in the housing and defining a substantially cylindrical inner surface;

a rotor arranged inside the lining member to rotate about a rotational axis, the rotor defining a substantially cylindrical outer surface, the inner surface of the lining member and the outer surface of the rotor defining a working space therebetween, the working space having a radial cross-sectional area which varies about the rotational axis; and a plurality of vanes received in substantially radial slots formed about the outer surface of the rotor, each of the vanes being arranged to slide in the radial direction with respect to the rotor such that an outer edge of the vane contacts the inner surface of the lining member, thereby dividing the working space into working chambers, wherein rotation of the rotor draws the fluid from the fluid inlet into the working chambers and ejects the fluid from the working chambers into the fluid outlet, and wherein the rotor is formed of a ceramic material.

The invention claimed is:

1. A sliding vane pump assembly for providing positive displacement of a fluid, the pump assembly comprising:

a housing having a fluid inlet and a fluid outlet formed therein;

a lining member received in the housing and defining a substantially cylindrical inner surface;

a rotor arranged inside the lining member to rotate about a rotational axis, the rotor defining a substantially cylindrical outer surface, the inner surface of the lining member and the outer surface of the rotor defining a working space therebetween, the working space having a radial cross-sectional area which varies about the rotational axis;

a plurality of vanes received in substantially radial slots formed about the outer surface of the rotor, each of the vanes being arranged to slide in a radial direction with respect to the rotor such that an outer edge of the vane contacts the inner surface of the lining member, thereby dividing the working space into working chambers, and first and second bearing members received in the housing and arranged at either end of the rotor, the bearing members defining end walls of the working chambers;

wherein rotation of the rotor draws the fluid from the fluid inlet into the working chambers and ejects the fluid from the working chambers into the fluid outlet, and wherein base portions of the slots formed in the rotor are in fluid communication with each other continuously throughout each revolution of the rotor, wherein the fluid communication is provided by a substantially circular groove formed in at least one of the end faces of the rotor and end faces of the bearing members; and wherein, in use of the pump assembly, the total volume of fluid under the vanes and in the substantially circular groove is substantially constant, so that there is a flow of fluid between the slots to equalize the pressure under the vanes; and wherein when the vane is urged in the radially inwards direction by direct contact of a radially outer face of the vane with the lining member, the increased pressure underneath the vane is transmitted through the groove to assist in urging another vane to move in the radially outwards direction.

2. The sliding vane pump assembly according to claim 1, wherein the fluid communication is provided by at least one fluid conduit in the pump assembly.

3. The sliding vane pump assembly according to claim 2, wherein the at least one fluid conduit is formed in the rotor.

4. The sliding vane pump assembly according to claim 1, wherein the at least one fluid conduit is formed, or further formed, in at least one of the first and second bearing members.

5. The sliding vane pump assembly according to claim 1, wherein the circular groove is coaxial with the rotor and has a radius corresponding to radial positions of the base portions of the slots of the rotor.

6. The sliding vane pump assembly according to claim 1, wherein the circular groove has a semi-circular or U-shaped cross-section.

7. The sliding vane pump assembly according to claim 1, wherein, except for the circular groove, the base portions of the slots of the rotor define substantially sealed volumes.

8. The sliding vane pump assembly according to claim 1, wherein the rotor is formed of a ceramic material.

9. The sliding vane pump assembly according to claim 8, wherein the ceramic material of the rotor comprises at least one of $Al_2O_3$, $Si_3N_4$ and $ZrO_2$.

10. The sliding vane pump assembly according claim 9, wherein the ceramic material of the rotor consists of $Al_2O_3$ having a purity of 96.0 to 99.9 wt %.

11. The sliding vane pump assembly according to claim 1, wherein the base portion of each of the slots formed in the rotor has an enlarged width and defines a rounded cross-sectional shape.

12. The sliding vane pump assembly according to claim 1, wherein the lining member is formed of a carbon graphite or ceramic material.

13. The sliding vane pump assembly according to claim 12, wherein an outer surface of the lining member is provided with a first recessed area in fluid communication with the fluid inlet and a second recessed area in fluid communication with the fluid outlet, and wherein the recessed areas and an inner surface of the housing together define fluid passageways for transferring fluid between the fluid inlet and fluid outlet and the working chambers.

14. The sliding vane pump assembly according to claim 13, wherein inner surfaces of the housing which face the outer surface of the lining member do not have any recessed areas.

15. The sliding vane pump assembly according to claim 13, wherein the lining member is a moulded component, and wherein the recessed areas are moulded into the outer surface of the lining member.

16. The sliding vane pump assembly according to claim 1, further comprising a drive shaft arranged to rotate about the rotational axis, wherein a drive end of the drive shaft extends out of the housing.

17. The sliding vane pump assembly according to claim 16, wherein the drive shaft is releasably engaged with the rotor for rotationally driving the rotor.

18. The sliding vane pump assembly according to claim 16, further comprising:

a bearing arranged to rotatably support the drive shaft adjacent to its drive end, the bearing comprising a rotatable part coupled to the drive shaft and a static part received in an end portion of the housing; and a mechanical seal arranged between the rotor and the bearing for preventing fluid leakage along the drive shaft and out of the end portion of the housing, the mechanical seal comprising a rotatable part coupled to the drive shaft and a static part coupled to the housing, wherein the rotatable part has a sealing surface which is resiliently biased into engagement with a sealing surface of the static part by a spring element.

19. The sliding vane pump assembly according to claim 18, wherein the static part of the mechanical seal is seated on a shoulder provided in the inner surface of the housing which faces the rotatable part of the mechanical seal, the shoulder providing a reaction force opposing the resilient bias of the spring element.

20. The sliding vane pump assembly according to claim 19, wherein each of the shoulders in the inner surface of the housing are integrally formed in the housing.

21. The sliding vane pump assembly according to claim 18, wherein the static part of the bearing is seated on a shoulder provided in the inner surface of the housing which faces the drive end of the drive shaft, and wherein the rotatable part of the bearing is seated on a shoulder provided in the drive shaft which faces the shoulder on which the static part is seated, such that the drive shaft is prevented from moving axially under the resilient bias of the spring element.

22. The sliding vane pump assembly according to claim 21, wherein the shoulder in the drive shaft is provided by a circlip mounted in a circumferential groove in the drive shaft.

23. The sliding vane pump assembly according to claim 1, wherein the bearing members are formed of a carbon graphite or ceramic material.

24. The sliding vane pump assembly according to claim 1, wherein each bearing member is provided with a first recessed area in fluid communication with the fluid inlet and each bearing member is provided with a second recessed area in fluid communication with the fluid outlet, and wherein the recessed areas and end surfaces of the lining member together define fluid passageways for transferring fluid between the fluid inlet and fluid outlet and the working chambers.

25. The sliding vane pump assembly according to claim 1, wherein the housing is a moulded plastics component.

26. The sliding vane pump assembly according to claim 1, wherein the vanes are formed of a carbon graphite material.

27. The sliding vane pump assembly according to claim 1, wherein the vanes are formed of a ceramic material.

28. The sliding vane pump assembly according to claim 1, further comprising a removable strainer assembly, the strainer assembly being received into an opening in the housing and extending across the fluid inlet for filtering particulate matter from the fluid.

29. The sliding vane pump assembly according to claim 28, wherein the strainer assembly comprises a strainer sleeve formed of porous or perforated material.

30. The sliding vane pump assembly according to claim 28, wherein the strainer assembly comprises a thermal sensor for providing an electrical signal indicative of temperature.

31. The sliding vane pump assembly according to claim 30, wherein the thermal sensor is provided in a sealing cap for the opening in the housing in which the strainer is received.

32. A sliding vane pump comprising:

the sliding vane pump assembly according to claim 1; and a prime mover arranged to rotatably drive the rotor of the sliding vane pump assembly.

33. The sliding vane pump according to claim 32, wherein the prime mover is an electric motor.

34. The sliding vane pump according to claim 32, wherein the sliding vane pump is configured for pumping water in a beverage carbonation system.

35. The sliding vane pump according to claim 32, wherein the sliding vane pump is configured for pumping water in an espresso coffee machine.

36. The sliding vane pump according to claim 32, wherein the sliding vane pump is configured for pumping fluid in reverse osmosis water treatment equipment.

37. The sliding vane pump according to claim 32, wherein the sliding vane pump is configured for pumping fluid in a heating or cooling circuit.

38. A sliding vane pump assembly for providing positive displacement of a fluid, the pump assembly comprising:

a housing having a fluid inlet and a fluid outlet formed therein;

a lining member received in the housing and defining a substantially cylindrical inner surface;

a rotor arranged inside the lining member to rotate about a rotational axis, the rotor defining a substantially cylindrical outer surface, the inner surface of the lining member and the outer surface of the rotor defining a working space therebetween, the working space having a radial cross-sectional area which varies about the rotational axis; and a plurality of vanes received in substantially radial slots formed about the outer surface of the rotor, each of the vanes being arranged to slide in a radial direction with respect to the rotor such that an outer edge of the vane contacts the inner surface of the lining member, thereby dividing the working space into working chambers, wherein rotation of the rotor draws the fluid from the fluid inlet into the working chambers and ejects the fluid from the working chambers into the fluid outlet, wherein base portions of the slots formed in the rotor are in fluid communication with each other, wherein the lining member is formed of a carbon graphite or ceramic material, and wherein an outer surface of the lining member is provided with a first recessed area in fluid communication with the fluid inlet and a second recessed area in fluid communication with the fluid outlet, and wherein the recessed areas and an inner surface of the housing together define fluid passageways for transferring fluid between the fluid inlet and fluid outlet and the working chambers.

39. The sliding vane pump assembly according to claim 38, wherein inner surfaces of the housing which face the outer surface of the lining member do not have any recessed areas.

40. The sliding vane pump assembly according to claim 38, wherein the lining member is a moulded component, and wherein the recessed areas are moulded into the outer surface of the lining member.

41. A sliding vane pump assembly for providing positive displacement of a fluid, the pump assembly comprising:

a housing having a fluid inlet and a fluid outlet formed therein;

a lining member received in the housing and defining a substantially cylindrical inner surface;

a rotor arranged inside the lining member to rotate about a rotational axis, the rotor defining a substantially cylindrical outer surface, the inner surface of the lining member and the outer surface of the rotor defining a working space therebetween, the working space having a radial cross-sectional area which varies about the rotational axis; and a plurality of vanes received in substantially radial slots formed about the outer surface of the rotor, each of the vanes being arranged to slide in a radial direction with respect to the rotor such that an outer edge of the vane contacts the inner surface of the lining member, thereby dividing the working space into working chambers, wherein rotation of the rotor draws the fluid from the fluid inlet into the working chambers and ejects the fluid from the working chambers into the fluid outlet, wherein base portions of the slots formed in the rotor are in fluid communication with each other, and wherein each bearing member is provided with a first recessed area in fluid communication with the fluid inlet and each bearing member is provided with a second recessed area in fluid communication with the fluid outlet, and wherein the recessed areas and end surfaces of the lining member together define fluid passageways for transferring fluid between the fluid inlet and fluid outlet and the working chambers.

* * * * *